US008419179B2

(12) United States Patent
Roof et al.

(10) Patent No.: US 8,419,179 B2
(45) Date of Patent: Apr. 16, 2013

(54) METHODS FOR UV GEL INK LEVELING AND DIRECT-TO-SUBSTRATE DIGITAL RADIATION CURABLE GEL INK PRINTING, APPARATUS AND SYSTEMS HAVING LEVELING MEMBER WITH A METAL OXIDE SURFACE

(75) Inventors: Bryan J. Roof, Newark, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 20 days.

(21) Appl. No.: 13/173,492

(22) Filed: Jun. 30, 2011

(65) Prior Publication Data

US 2013/0002770 A1 Jan. 3, 2013

(51) Int. Cl.
*B41J 2/01* (2006.01)

(52) U.S. Cl.
USPC ..... 347/102; 347/101; 347/103; 347/104; 347/30; 347/40; 427/511

(58) Field of Classification Search ..... None
See application file for complete search history.

(56) References Cited

U.S. PATENT DOCUMENTS

| | | | | |
|---|---|---|---|---|
| 5,649,481 | A * | 7/1997 | Muller et al. | 101/148 |
| 7,419,257 | B2 * | 9/2008 | Mouri et al. | 347/103 |
| 8,136,936 | B2 * | 3/2012 | Hook et al. | 347/103 |
| 8,231,214 | B2 * | 7/2012 | Roof et al. | 347/102 |
| 8,240,808 | B2 * | 8/2012 | Sasayama | 347/30 |
| 8,334,026 | B2 * | 12/2012 | Chretien et al. | 427/511 |
| 2002/0027587 | A1 * | 3/2002 | Sugaya et al. | 347/104 |
| 2003/0205059 | A1 * | 11/2003 | Roche et al. | 65/60.1 |
| 2005/0190248 | A1 * | 9/2005 | Konno et al. | 347/102 |

* cited by examiner

*Primary Examiner* — Matthew Luu
*Assistant Examiner* — John P Zimmermann
(74) *Attorney, Agent, or Firm* — Ronald E. Prass, Jr.; PRASS LLP

(57) ABSTRACT

A radiation curable gel ink leveling method for digital direct-to-substrate radiation curable gel ink printing includes depositing radiation curable gel ink directly onto a substrate, irradiating the gel ink to increase a viscosity of the gel ink, adding sacrificial release fluid to a hydrophilic leveling roll surface, the leveling roll surface including metal oxide, and leveling the ink with the leveling roll. UV gel ink printing systems and leveling apparatus include a leveling roll having a metal oxide surface suitable for use with water based release fluids that contain a surfactant and/or polymer.

19 Claims, 3 Drawing Sheets

METHODS FOR UV GEL INK LEVELING AND DIRECT-TO-SUBSTRATE DIGITAL RADIATION CURABLE GEL INK PRINTING, APPARATUS AND SYSTEMS HAVING LEVELING MEMBER WITH A METAL OXIDE SURFACE

RELATED APPLICATIONS

This application is related to U.S. patent application METHODS FOR RADIATION CURABLE GEL INK LEVELING AND DIRECT-TO-SUBSTRATE DIGITAL RADIATION CURABLE GEL INK PRINTING, APPARATUS AND SYSTEMS HAVING PRESSURE MEMBER WITH HYDROPHOBIC SURFACE (Ser. No. 13/179,063), the disclosure of which is incorporated herein by reference in its entirety.

FIELD OF DISCLOSURE

The disclosure relates to methods, apparatus, and systems for radiation curable gel ink leveling. In particular, the disclosure relates to methods, apparatus, and systems for contact leveling gel ink using a metal oxide-coated surface of a leveling roll.

BACKGROUND

Radiation curable gel inks, e.g., UV curable gel inks, tend to form drops having less mobility than those formed by conventional inks when jetted directly onto a substrate. When UV gel inks are jetted from a print head to be deposited directly onto a substrate to form an image, the ink drops are liquid. When the drops contact the substrate, they are quickly quenched to a gel state, and therefore have limited mobility.

Conventional inks tend to form mobile liquid drops upon contact with a substrate. To prevent coalescence of the mobile liquid ink drops during printing, substrates are typically coated and/or treated. For example, a paper substrate for use with conventional inks may be coated with materials that increase adhesion characteristics and increase surface energy, or otherwise affect chemical interaction between the paper substrate and inks. Such coatings or treatments require special operations to apply to the media, and additional cost is associated with their use in printing operations. For example, a printing process using digital presses and conventional presses may require different media supplies suitable for each press.

Radiation curable gel inks are advantageous for printing operations at least because they exhibit superior drop positioning on a variety of substrate types, regardless of how the substrates are treated. It is cost advantageous, for example, to run the same media or substrate type across multiple printing apparatuses and not to have to carry, for example, specially coated stock.

SUMMARY

Radiation curable gel ink images may suffer from print artifacts such as a corduroy appearance attributed to hills and valleys caused by inconsistent ink drop line thicknesses and/or objectionable pile heights. Relying on a flood coat to achieve jetted gel ink line uniformity, and/or address varying line thickness and obviate objectionable print artifacts, can be costly and lead to a high gloss level that may be undesirable for some print jobs. Gel ink processes may benefit from apparatus, and systems that cost-efficiently and effectively address objectionable pile heights and/or inconsistent ink line thicknesses by leveling gel ink after the ink is jetted directly onto a substrate, without otherwise degrading the printed image by, for example, offsetting gel ink onto the contact member.

Systems in accordance with an embodiment may include a radiation curable gel ink printing system having a print head for jetting radiation curable gel ink, such as ultra-violet ("UV") gel ink, directly onto a substrate such as a paper web. In another embodiment, gel ink may be deposited on the substrate by one or more of any other radiation cure ink deposition methods and/or systems.

Systems of embodiments may include a UV curable ink leveling apparatus having a contact member adapted to contact and/or applying pressure to the jetted UV gel ink on the substrate with minimal or no offset of ink to the contact member. The contact member includes a hydrophilic outer contact surface that contacts a fluid layer, which contacts the ink on the substrate. The contact member may be associated with an opposing member to define a leveling nip through which the substrate may translate in a process direction.

Apparatus and systems in accordance with an embodiment may include one or more UV sources for applying UV radiation to UV curable gel ink. The UV source may be adapted to cure the gel ink to a desired degree, or polymerize a desired amount of the gel ink. For example, the gel ink may be cured so that a small proportion of exposed ink is polymerized. Alternatively, the gel ink may be cured so that a substantial portion of exposed ink is polymerized. In particular, the UV source may be configured to apply radiation to gel ink positioned on a substrate such that the gel ink thickens, thus allowing a contact member to contact the ink with minimal or no offsetting of the ink to the contact member. A UV source may be configured to cure the ink after the ink has been leveled by a contact member. Systems may include a first UV source for irradiating a gel ink image before the gel ink is leveled at a leveling nip, and a second UV sourced for irradiating the gel ink after the gel ink is leveled to cure the gel ink image. Systems may be configured to deposit, level, and cure radiation curable inks using curing systems other than UV, such as e-beam systems.

Apparatus and systems may include a contact member having a contact surface that is hydrophilic, durable, and relatively inexpensive and easy to obtain. In particular, apparatus and systems include a contact surface comprising a metal oxide. The metal oxide may be plasma sprayed onto a surface of the contact member. In an embodiment, the contact surface may comprise a plasma sprayed metal oxide coating that is ground and polished to produce a fine porous matrix. The contact surface of the contact member may comprise titanium dioxide or titania. In an alternative embodiment, a contact surface of a contact member may comprise chromium oxide.

Apparatus and system may include a sacrificial release layer fluid system for containing and/or adding sacrificial release layer fluid to a surface of a contact member. For example, release fluid may be added to a surface of a contact member in a print process before the contact member contacts a deposited UV gel ink image to level the ink of the gel ink image.

Methods of an embodiment may include contacting radiation curable gel ink, such as UV gel ink, that is deposited directly onto a substrate, such as a paper web, with a contact member having a metal oxide surface. The contact member may be a rotatable roll having a hydrophilic ceramic surface, and may be associated with an opposing member to define a leveling nip through which the substrate may be translated in a process direction. In an embodiment the contact member may have a contact surface comprising titanium dioxide. In an alternative embodiment, the contact surface may comprise chromium oxide.

Methods in accordance with an embodiment may include applying UV radiation to UV gel ink that has been jetted directly onto a surface of a substrate by an ink jet print head. In particular, a UV source may be adapted to cure the gel ink thereby to altering a viscosity of the ink. For example, the ink image may be only partially polymerized, or a substantial proportion of the ink of the ink image may be polymerized for a final cure. Preferably, UV radiation may be applied to the jetted UV gel ink to thicken the ink before contacting the ink with a contact member for leveling, thereby minimizing offset of the ink to the contact member during the leveling process. In other embodiments, radiation curable gel ink may used, and any system configured to apply radiation that is effective for polymerizing an amount of ink may be used, including, for example, e-beam systems.

In another embodiment, methods include adding a water-based sacrificial release fluid to a contact surface of a contact member of a leveling apparatus before applying a metal oxide surface of the contact member to radiation curable gel ink, e.g., UV gel ink, which has been deposited directly onto a substrate. The contact member may comprise a plasma sprayed metal oxide ceramic surface that forms a fine porous matrix. For example, the contact member may comprise a metal oxide ceramic surface having a thickness of about 25 microns. The plasma sprayed metal oxide particle size may be about 5 microns or less. The sacrificial release layer may include water and surfactant and/or suitable polymers.

Systems in accordance with another embodiment include a UV gel ink leveling apparatus for direct-to-substrate UV gel ink digital printing systems having a contact member including a metal oxide-comprising surface that facilitates retention of water, formation of a release fluid film, and accommodation of water based release fluids. A contact surface of the contact member may be formed by plasma spraying metal oxide onto a surface of the contact member, grounding the sprayed metal oxide particles, polishing the metal oxide on the contact surface to form a fine, porous metal oxide matrix. A fluid release system may be configured to add water based sacrificial release fluid to a surface of a contact member.

Exemplary embodiments are described herein. It is envisioned, however, that any systems that incorporate features of methods, apparatus, and systems described herein are encompassed by the scope and spirit of the exemplary embodiments.

DETAILED DESCRIPTION

Figure 1:
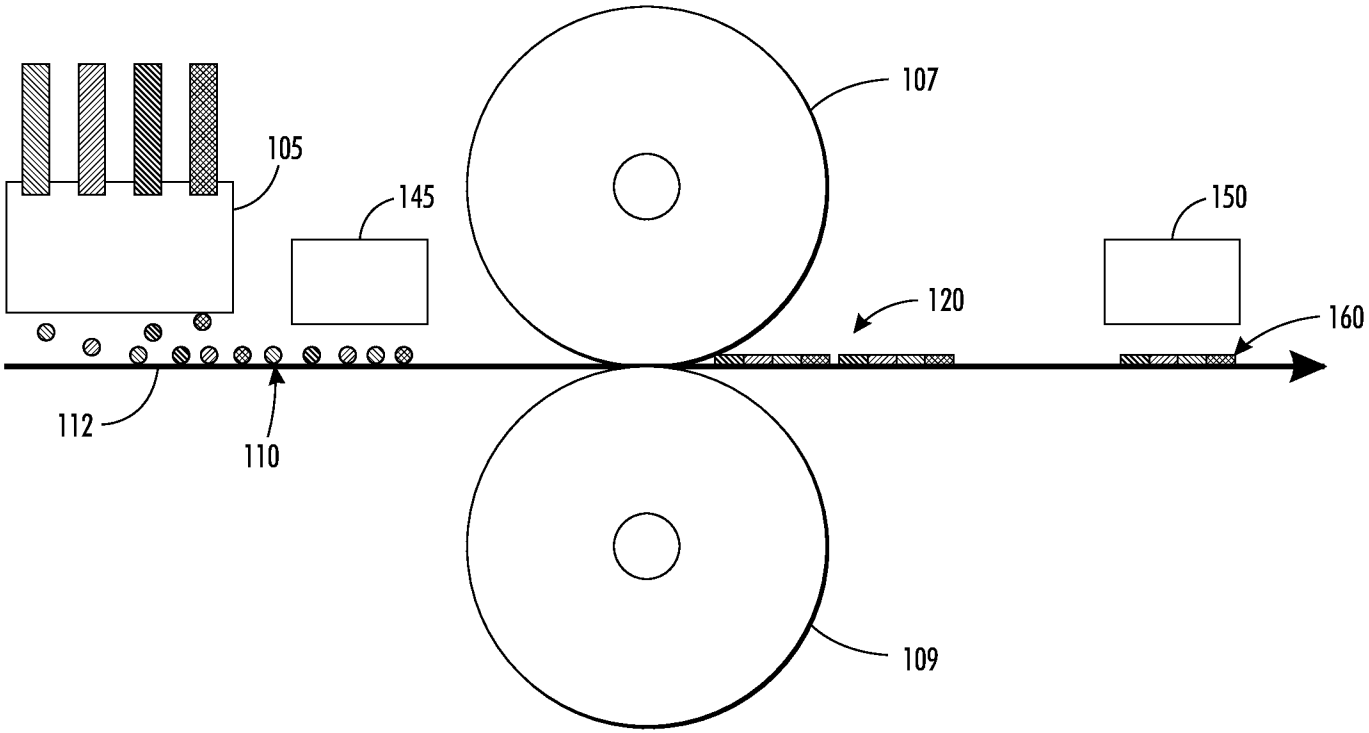
FIG. 1 shows a diagrammatical side view of a UV gel ink leveling system in accordance with an exemplary embodiment.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for radiation curable gel ink leveling. In the drawings, like reference numerals are used throughout to designate similar or identical elements. The drawings depict various embodiments and data related to embodiments of illustrative methods, apparatus, and systems for leveling UV gel ink that has been jetted directly onto a substrate, such as a media web or cut sheet.

FIG. 1 shows a radiation curable gel ink printing system and leveling apparatus in accordance with an exemplary embodiment. Specifically, FIG. 1 shows a UV gel ink printing system having a print head 105 for jetting UV gel ink. The UV gel ink printing system may include a leveling apparatus having a contact member 107. The print head 105 may be configured, e.g., to jet or deposit UV gel ink directly onto a substrate to form an as-jetted image 110. For example, print head 105 may jet ink onto a substrate such as web 112. The web may be a paper web, for example. In an alternative embodiment, the substrate may be a cut sheet. The print head 105 may be configured to contain and/or deposit or jet one or more inks, which may be black, clear, magenta, cyan, yellow or any other desired ink color.

The gel ink may be any radiation curable ink. For example, the gel ink may be curable by UV radiation. Further, the gel ink may be deposited by means other than an ink jet print head. The ink may be deposited directly onto the substrate by any suitable ink deposition means. For example, the ink may be jetted by ink jet print head 105 as shown in FIG. 1, or may be deposited by systems such as microelectromechanical systems configured to deposit gel ink onto a substrate, including gel ink that is heated to a liquid state.

After UV gel ink has been jetted onto the web 112, the web may be translated in a process direction to a contact member 107 of a leveling apparatus. As shown in FIG. 1, the contact member 107 may be a drum or roll that is rotatable about a central longitudinal axis. The contact member may include a contact surface, which may be configured to contact jetted ink, e.g., jetted ink image 110, on an ink bearing surface of the substrate 112.

In an embodiment, the contact member 107 may be associated with an opposing member such as a pressure roll, and may be configured to define a leveling nip therewith for roll-on-roll leveling. The web 112 may be configured to carry the jetted ink image 110 through the nip to level the gel ink of the ink image 110. The contact member 107 levels the ink of the jetted ink image 110 by applying pressure to the ink on the substrate to produce a leveled ink image 120.

In an embodiment, the contact member 107 may be associated with a UV source. As shown in FIG. 1, the UV gel ink printing system may include a UV source 145. The UV source 145 may be arranged to apply UV radiation to ink of the jetted ink image 110 before the ink is leveled by the contact member 107.

The UV source 145 may be configured to cure the ink such that an amount of the ink polymerizes. For example, a small of amount of ink comprising the ink image 110 may be polymerized. Alternatively, a substantial amount of the ink may be polymerized. For example, a UV source may be adapted to irradiate UV curable gel ink of a gel ink image to produce a final cure.

Preferably, the UV source 145 may be configured to apply UV radiation to the gel ink of the ink image 110 to polymerize enough of the gel ink to alter a viscosity of the ink before the ink is contacted by the contact member 107. For example, the viscosity of the ink may be altered to minimize or eliminate offset of the UV curable gel ink to the contact member 107 during leveling and/or contact of the ink by the contact member 107 at the leveling nip. The amount of cure required to minimize or prevent offset may depend on ink properties, including, for example, amount of gel, monomer composition, and an amount of photoinitiator present. Further, an amount of cure to apply may depend on radiation wavelength and interaction with the photoinitiator, and exposure, including a combination of wavelength, intensity, and time.

In an embodiment, the UV source 145 may be a first UV source, and a UV curable gel ink digital printing system may include a second UV source 150. The second UV source 150 may be configured to apply UV radiation after the ink of the image 110 is leveled by the contact member 107 to produce the leveled ink image 120. As shown in FIG. 1, the UV source 150 may be used to irradiate the leveled ink image 120 to produce a final cured ink image 160. In other embodiments, a radiation source may be configured to irradiate and cure radiation curable inks by means other than UV radiation. For example, e-beam systems may be used.

The contact member 107 may be a leveling roll that is configured to apply pressure to ink of the jetted ink image 110 to produce a leveled ink image 120. For example, the contact member 107 may be a leveling roll configured to rotate about a central longitudinal axis. The leveling roll may be associated with a pressure member such as a pressure roll to define a leveling nip for roll-on-roll leveling. The contact member 107 may include a contact surface that contacts the ink of the jetted ink image 110. Before the contact member 107 contacts the ink, a viscosity of the ink may be altered by the UV source 145. For example, the ink may be thickened to, e.g., minimize or prevent offset of the ink to the contact member 107 during leveling. The ink may be thickened as desired by applying an amount of cure required to minimize or prevent offset. The amount of cure applied may depend on ink properties, including, for example, amount of gel, monomer composition, and an amount of photoinitiator present. Further, an amount of cure to apply may depend on radiation wavelength and interaction with the photoinitiator, and exposure, including a combination of wavelength, intensity, and time.

The contact surface of the contact member 107 may be a hydrophilic surface that is durable and relatively inexpensive to produce. For example, the contact surface of the contact member 107 may comprise metal oxide. In an embodiment, the contact member 107 may comprise titanium dioxide or titania. In another embodiment, the contact surface of the contact member 107 may comprise chromium oxide. A hydrophilic contact surface comprising metal oxides such as chromium oxide, and preferably, titanium dioxide may accommodate absorption of water-based release fluids, which further accommodates effective leveling of the UV gel ink by minimizing or preventing offset of gel ink from the substrate 112 to the contact member 107.

The hydrophilic metal oxide particles arrangement in/on the surface of the contact member 107 to form a porous structure that retains water by capillary function. For example, the contact surface may be formed by plasma spraying hydrophilic metal oxide particles such as titanium dioxide, and grounding and polishing the particles to produce a fine matrix with pores that act as capillary media for a water-based fountain solution. While the surface energy of the individual metal oxide particles may be higher than the surface energy for substances such as Teflon, a metal oxide-containing contact surface accommodates improved offset performance, or resistance to offset for a particular ink viscosity, by aiding in retention and filming of water based release fluids for gel ink leveling.

Release fluid may be added to a surface of the contact member 107 before the contact surface contacts a jetted ink image 110 for leveling. For example, a sacrificial release layer fluid may be contained by a leveling apparatus release fluid system (not shown). The release fluid system may be configured to contain and/or deposit release fluid onto a surface of the contact member 107. Exemplary release fluids that may be effectively used with, e.g., a titanium dioxide ceramic surface includes sodium dodecyl sulfate (SDS) based fountain solutions, and preferably polymer based fountain solution such as SILGAURD. Release fluids may include water-soluble short chain silicones, water with surfactants, defoamers, and other fluids suitable for forming a sacrificial release layer.

Figure 2:
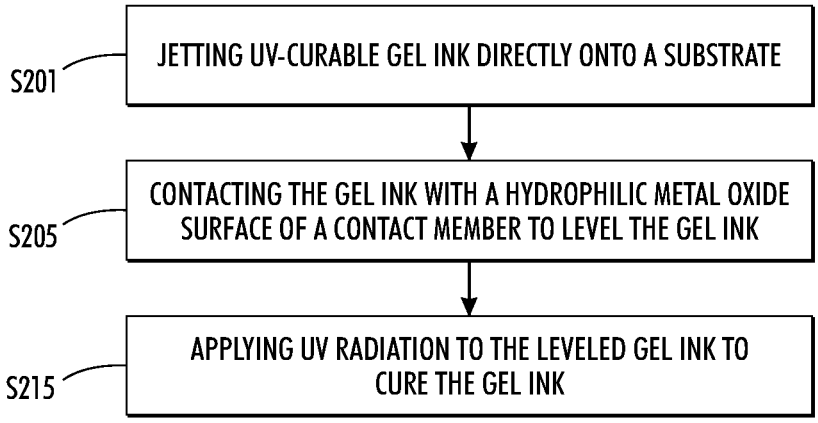
FIG. 2 shows a UV gel ink leveling and curing process in accordance with an exemplary embodiment.

FIG. 2 shows an embodiment of methods for leveling radiation curable inks, such as UV-curable gel ink, in a direct-to-substrate digital printing process. Methods may include depositing, e.g., jetting UV-curable gel ink directly onto a substrate at S201. The UV curable gel ink may be jetted by an ink jet print head. The substrate may be a media web such as a paper web. Alternatively, the substrate may be a paper cut sheet.

After jetting the ink at S201, methods may include contacting the gel ink with a hydrophilic metal oxide surface of a contact member of a UV gel ink leveling apparatus to level the gel ink. The contact member may be associated with an opposing member to form a leveling nip. The leveling nip may be arranged downstream, in a process direction, from the print head, and the substrate may be translated to carry gel ink jetted by the print head to the leveling nip of the leveling apparatus. After the ink is leveled at S205, the ink may be irradiated with UV radiation by a UV source. The UV source may be configured to apply radiation to the ink to polymerize the ink and/or cure the ink of the ink image to produce a final cured image. In an alternative embodiment, radiation curable gel ink may be irradiated with radiation sources other than UV sources, and may be irradiate by systems such as e-beam systems.

Figure 3:
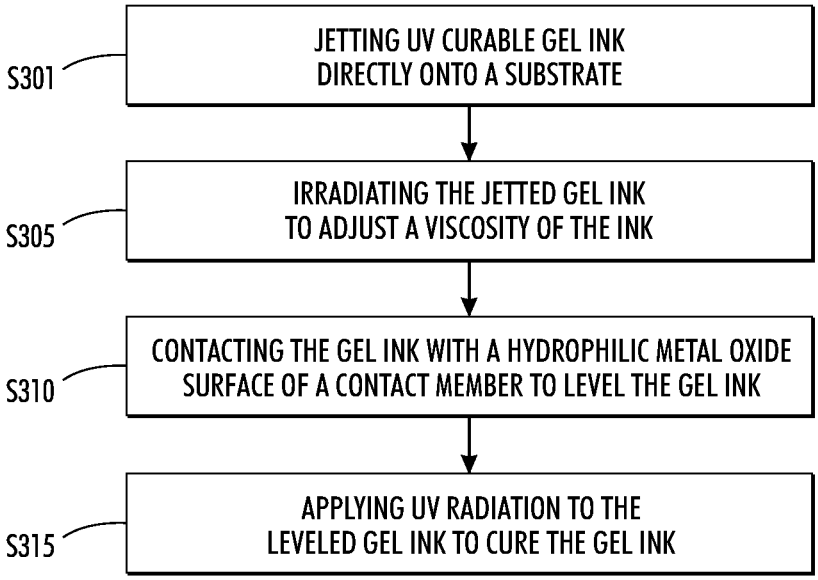
FIG. 3 shows a UV gel ink leveling and curing process in accordance with an exemplary embodiment.

FIG. 3 shows another embodiment of methods for leveling UV-curable gel ink in a direct-to-substrate digital printing process. As shown in FIG. 3, methods may include jetting UV-curable gel ink directly onto a substrate at S301. The substrate may be a media web, such as a paper web. Alternatively, the substrate may be a cut sheet. At S305, a UV source may apply radiation to the UV curable gel ink jetted onto the substrate. The radiation may adjust a viscosity of the ink. Specifically, the ink may be thickened at S305. The ink may be thickened to minimize or prevent offset of the ink on a leveling member or other surface.

The thickened ink and substrate may be advanced to a leveling nip for leveling. The nip may be defined by a contact member, such as a leveling roll, and an opposing member, e.g., a roll. The leveling roll includes a metal oxide surface for contacting the UV curable gel ink jetted on the substrate at S301 and thickened at S305. The metal oxide contact surface may include chromium oxide. Preferably, the contact surface may include titanium dioxide. The metal oxide surface may be formed by plasma spray, grounding, and polishing metal oxides on a surface of a contact member to produce a porous fine metal oxide matrix. At S310, the contact member may contact the ink jetted onto the substrate and thickened by the UV source to level the ink. The leveled ink may be advanced to a UV source for curing the gel ink. For example, radiation may be applied to a leveled ink image on a substrate to produce a final cured UV curable gel ink image.

Figure 4:
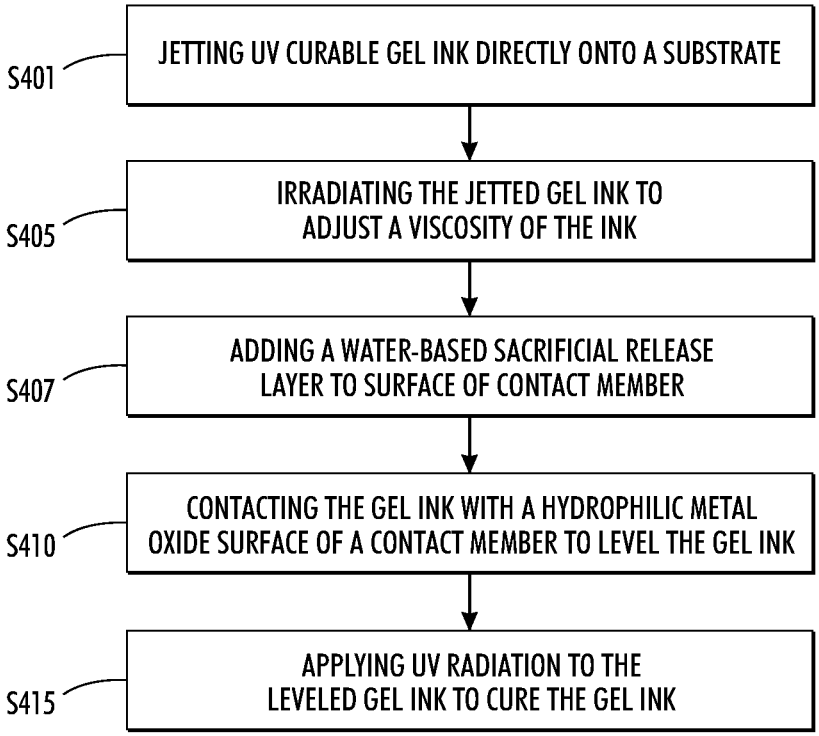
FIG. 4 shows a UV gel ink leveling and curing process in accordance with an exemplary embodiment.

FIG. 4 shows another embodiment of methods for leveling UV-curable gel ink in a direct-to-substrate digital printing process. As shown in FIG. 4, methods may include jetting UV-curable gel ink directly onto a substrate at S401. The substrate may be a media web, such as a paper web. Alternatively, the substrate may be a cut sheet. At S405, a UV source may apply radiation to the UV curable gel ink jetted onto the substrate. The radiation may adjust a viscosity of the ink. Specifically, the viscosity of the ink may be increased at S405. For example, the ink may be thickened to minimize or prevent the ink from offsetting onto a leveling member or other surface.

The thickened ink and substrate may be advanced to a leveling nip for leveling. The nip may be defined by a contact member, such as a leveling roll, and an opposing member, e.g., a roll. The leveling roll includes a metal oxide surface for contacting the UV curable gel ink jetted on the substrate at S401 and thickened at S405. The metal oxide contact surface may include chromium oxide. Preferably, the contact surface may include titanium dioxide. The metal oxide surface may be formed by plasma spray, grounding, and polishing metal oxides on a surface of a contact member to produce a porous fine metal oxide matrix that retains water and facilitates formation of a water based release fluid film on a surface of the contact member.

Release fluids may be added to the surface of the contact member at S407. The release fluids may be water based fluids. An exemplary release fluid may be SDS, or preferably polymer containing release fluids such as SILGAURD. Release fluids may include water-soluble short chain silicones, water with surfactants, defoamers, and other fluids suitable for forming a sacrificial release layer.

Release fluid for forming a sacrificial release layer on a contact surface of a contact member may be contained and/or deposited onto the contact surface by a release fluid system. At S410, the contact member having the added sacrificial release fluid on its surface may contact the ink jetted onto the substrate and thickened by the UV source to level the ink. The leveled ink may be cured at S415.

At S410, the contact member may contact the ink jetted onto the substrate, and thickened by the UV source to level the ink. The leveled ink may be advanced to another UV source for curing the gel ink. For example, radiation may be applied to a leveled ink image on a substrate to produce a final cured UV curable gel ink image.

Figure 5:
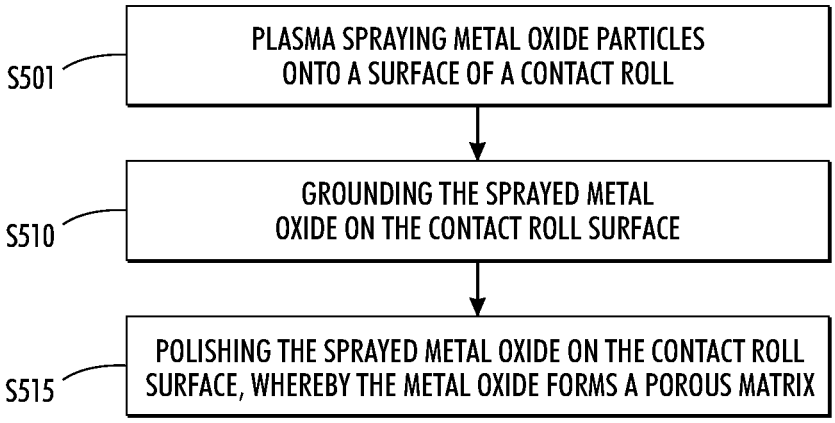
FIG. 5 shows a process for forming a contact surface of a contact member of a UV gel ink leveling apparatus and UV curable gel direct-to-substrate digital printing systems.

FIG. 5 shows a process form forming a contact surface of a contact member of leveling apparatus and UV gel ink direct-to-substrate digital printing systems. Specifically, FIG. 5 shows at S501 plasma spraying a surface of a contact member such as a cylindrical leveling roll with metal oxide particles. For example, chromium oxide may be sprayed onto a surface of the leveling roll. Preferably, titanium dioxide may be plasma sprayed onto a surface of the leveling roll.

After plasma spraying metal oxide onto a surface of a contact member such as a leveling roll at S501, the deposited metal oxides may be ground on the contact member surface at S510. Then, the deposited metal oxides may be polished on the contact member surface at S515, whereby the metal oxide forms a fine porous matrix. The porous matrix may be formed for contributing to a water retentive and film forming contact member surface by way of capillary action. For example, the contact member may comprise a metal oxide ceramic surface having a thickness of about 25 microns. The plasma sprayed metal oxide particle size may be about 5 microns or less.

While methods, apparatus, and systems for radiation curable gel ink leveling in direct-to-substrate printing operations are described in relationship to exemplary embodiments, many alternatives, modifications, and variations would be apparent to those skilled in the art. Accordingly, embodiments of methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A radiation-curable gel ink leveling method, comprising:

jetting radiation-curable gel ink directly from a print head onto the substrate for forming a radiation curable gel ink image; and directly contacting the radiation-curable gel ink jetted on the substrate with a contact member, the contact member having a contact surface comprising metal oxide.

2. The method of claim 1, wherein the surface of the contact member comprises titanium dioxide.

3. The method of claim 1, further comprising:

applying UV radiation to the gel ink to increase a viscosity of the radiation-curable ink, the ink being UV curable.

4. The method of claim 1, further comprising:

applying UV radiation to the gel ink before contacting the ink with the contact member, the gel ink being UV curable.

5. The method of claim 1, wherein the surface of the contact member comprises chromium oxide.

6. The method of claim 1, the contacting further comprising leveling the jetted gel ink by applying pressure to the ink with the contact member.

7. The method of claim 1, further comprising:

adding a water based sacrificial release fluid to a surface of the contact member before contacting the gel ink with the contact member, the water based release fluid comprising at least one of a surfactant and a polymer, the surface of the contact member being hydrophilic.

8. The method of claim 1, further comprising:

irradiating with UV light the leveled gel ink to cure the gel ink.

9. A radiation curable gel ink leveling apparatus, comprising:

a contact member having a contact surface for contacting gel ink on a substrate after the gel ink is jetted directly onto the substrate and before finally curing the gel ink, the contact surface comprising a metal oxide.

10. The apparatus of claim 9, wherein the metal oxide comprises titanium dioxide.

11. The apparatus of claim 9, wherein the metal oxide comprises chromium oxide.

12. The apparatus of claim 9, further comprising:

a radiation source.

13. The apparatus of claim 9, further comprising:

a first radiation source configured to increase a jetted gel ink viscosity before the contact member contacts the gel ink on the substrate in a print process; and a second radiation source configured to cure the gel ink after the contact member contacts the gel ink on the substrate in a print process.

14. The apparatus of claim 12, the radiation source being configured to irradiate the gel ink before the contact member contacts the gel ink.

15. The apparatus of claim 12, the radiation source being configured to apply UV radiation to the gel ink, the gel ink being UV curable.

16. The apparatus of claim 9, further comprising:

an ink jet print head, the print head being configured to jet the gel ink directly onto the substrate.

17. A radiation curable gel ink direct-to-substrate digital printing system, comprising:

an ink jet print head configured to jet radiation curable gel ink directly onto a substrate to form a gel ink image;

a leveling apparatus, the leveling apparatus including a contact member, the contact member being configured to contact the gel ink on the substrate, the contact member comprising a hydrophilic contact surface, the contact surface comprising metal oxide; and a sacrificial release fluid system configured to add a water based release fluid to the contact surface before the contact surface contacts the gel ink.

18. The system of claim 17, further comprising:

a UV source configured to cure the gel ink after the contact member contacts the gel ink, the gel ink being UV curable.

19. The method of claim 17, further comprising:

a UV source configured to apply UV radiation to the gel ink before the contact member contacts the gel ink.

* * * * *